US007280083B1

(12) United States Patent
Adamski

(10) Patent No.: US 7,280,083 B1
(45) Date of Patent: Oct. 9, 2007

(54) PHASED ARRAY BLADE ANTENNA ASSEMBLY

(75) Inventor: Piotr Roman Adamski, Port Hueneme, CA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/506,266

(22) Filed: Aug. 8, 2006

(51) Int. Cl.
*H01Q 21/12* (2006.01)

(52) U.S. Cl. ..... 343/814; 343/816; 343/821

(58) Field of Classification Search ..... 343/810, 343/814, 816, 821
See application file for complete search history.

(56) References Cited

U.S. PATENT DOCUMENTS 3,656,167 A * 4/1972 Lea ..... 343/793
4,758,843 A * 7/1988 Agrawal et al. ..... 343/814
6,657,601 B2 * 12/2003 McLean ..... 343/792

* cited by examiner

*Primary Examiner*—Hoang V. Nguyen
(74) *Attorney, Agent, or Firm*—Robert R. Lerma; David S. Kalmbaugh

(57) ABSTRACT

An antenna design, having two symmetrical phased array blade antenna elements which provide improved lateral target coverage with an increased effective radiated power and exhibits smooth null-free bi-directional antenna patterns. Each blade antenna element is coupled to a 180 degrees hybrid divider/combiner by a semi-rigid RF cable. Each blade antenna element is also connected to a sub-resonant choke balun for improved impedance matching and resultant distortion-less antenna patterns.

11 Claims, 5 Drawing Sheets

PHASED ARRAY BLADE ANTENNA ASSEMBLY

BACKGROUND OF THE INVENTION

1. Field of the Invention

The present invention relates generally to a phased array antenna for use on an airborne platform whose mission is electronic transmission of RF signals. In particular, the present invention relates to a broadband blade array antenna system which includes a pair of modified-shape lightweight dipole blades designed to fit within a radome.

2. Description of the Prior Art

The industry has a number of airborne antennas used with different airborne amplifiers and covering a broad range of frequencies. However, most of the antennas, especially those covering lower frequency bands, provide less than optimal pattern coverage and thus reduced Effective Radiated Power (ERP) performance. This is mainly due to a strong interaction between the antenna radiation fields and the aircraft wings or fuselage at lower operating frequencies. At these lower frequencies the aircraft itself becomes a large contributor to the antenna pattern distortion and produces adverse antenna impedance variations due to antenna and aircraft body proximity. The preexisting antenna designs feature less than optimal gain and largely irregular antenna patterns in the lateral direction significantly reducing operational effectiveness.

There are no known airborne antenna designs in the prior art that will operate in the desired frequency range and avoid the detrimental interaction of the radiated fields with the airplane structure.

SUMMARY OF THE INVENTION

The antenna design comprises a two-element phased array blade antenna (PAB) assembly which provides improved lateral target coverage with an increased effective radiated power and exhibits smooth null-free bi-directional lateral antenna patterns. Each antenna blade pair is coupled to a 180 degree hybrid divider/combiner by a semi-rigid Radio Frequency (RF) cable. Each blade set is also connected to a sub-resonant choke balun 35 shown in FIG. 1 for improved impedance matching performance characteristics.

This antenna design provides a superior antenna input Voltage Standing Wave Ratio (VSWR), smooth lateral pattern coverage, large antenna gain and Electro-Magnetic (EM) Interference suppression. Moreover, broadband antenna performance is achieved with a unique antenna blade design that not only improves the usable frequency range of the antenna, but also provides for a light weight construction that is required for most airborne antenna systems.

Another unique feature of this antenna array design is the fact that it does not require any impedance matching networks since the antenna blade construction features a 50 ohm nominal input impedance. This feature is a major antenna design simplification beneficial in reducing construction cost, increasing reliability and also reducing RF insertion loss. The transformation of an unbalanced RF input coaxial cable to a balanced dipole configuration is accomplished with two sub-resonant choke baluns, each made out of a semi-rigid RF feed cable. This approach gives the lowest cost antenna balun implementation with more than adequate performance and, most of all, maximum design simplicity. The innovative antenna blade design provides a well-behaved antenna input impedance characteristic that covers approximately 22% of the bandwidth around the center or target design frequency.

DETAILED DESCRIPTION OF A PREFERRED EMBODIMENT

Figure 1:
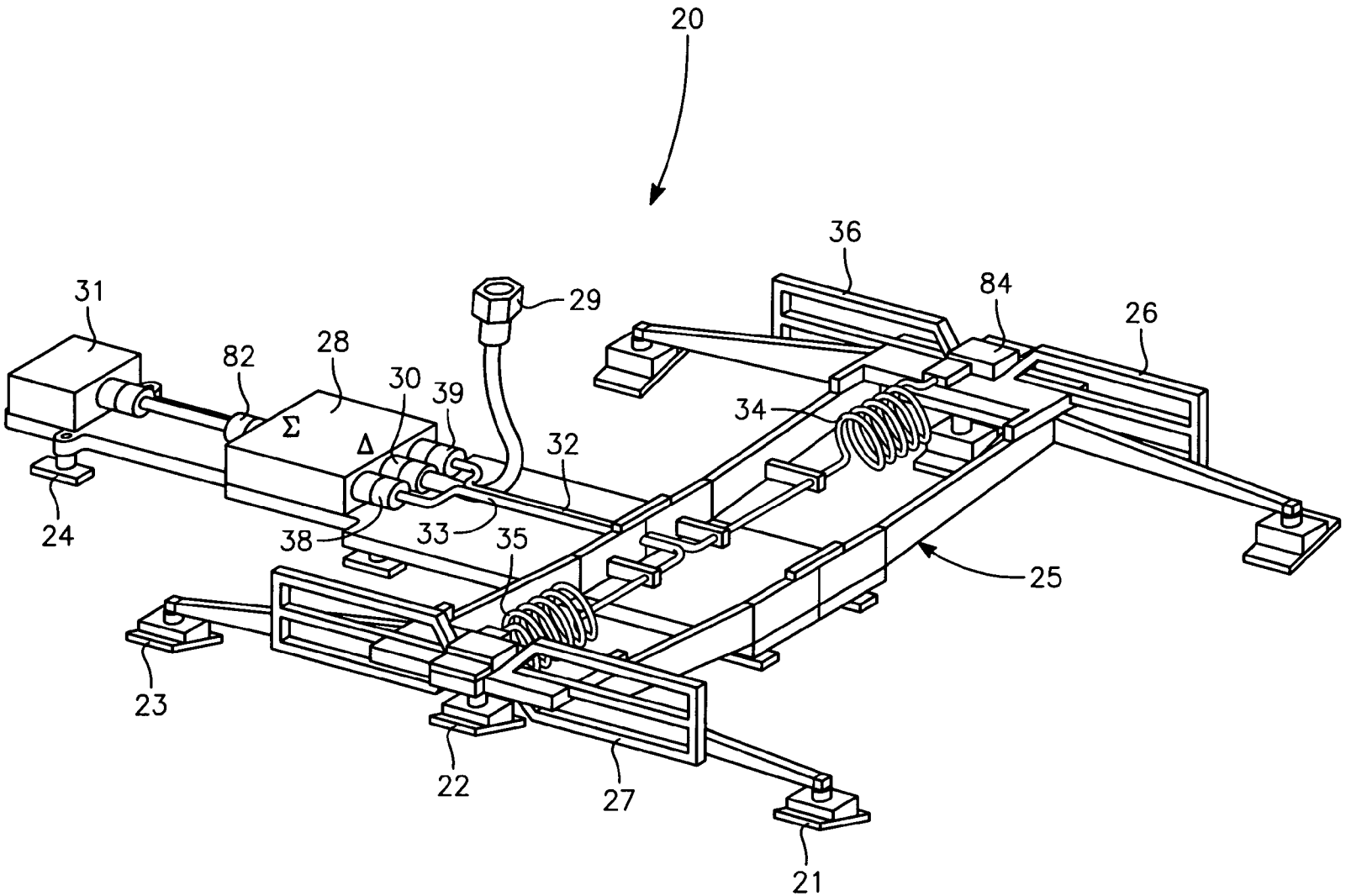
FIG. 1 is a view of the Phased Array Blade (PAB) assembly and mounting structure comprising the present invention.

Referring to FIG. 1, the preferred embodiment of the phased array blade (PAB) antenna assembly 20 is shown in FIG. 1. The PAB antenna assembly 20 fits within the constraints of a radome intended for use on an aircraft. Clamps 21, 22, 23 and 24 are mounted on a structure made of a dielectric substrate 25 and placed as shown to anchor the PAB antenna assembly 20 to the radome. The quantity of clamps mounted on the dielectric substrate 25 can be increased in order to achieve the desired stability.

The PAB antenna assembly 20 of FIG. 1 contains two modified dipole antenna elements 26 and 27 spatially separated by a distance approximated by $\lambda/2$. This design requires that the dipole element optimal separation be set to accommodate the center frequency of interest. Due to the radome spatial fitting constraints, a dipole elements spacing deviation from $\lambda/2$ within +/−20% will also provide acceptable performance of the antenna assembly 20.

The RF signal that feeds the PAB antenna assembly 20 is split equally in amplitude and 180 degrees out of phase. This signal split and phase shift is accomplished with a device known in the art as a broadband high power 180 degree hybrid device 28, which is commercially available and more commonly known as a combiner/divider. The input RF is connected to the hybrid device 28 via an RF input cable 29 which is connected directly to the input port 30 of the broadband high power 180 degree hybrid device 28. The benefit of using the 180 degree hybrid device 28 as opposed to an in-phase power divider is twofold; it dissipates common mode currents as heat into a dummy load 31 which is connected to the unused $\Sigma$ input port 82 of the hybrid device 28 and second, due to the design symmetry, the confusion of crossing transmission lines during the manufacturing process is eliminated. The possibility of not crossing transmission lines to achieve the needed 180 degree phase shift during the manufacturing process is high if an in-phase power divider were used instead of the hybrid device 28. The signal output ports 38 and 39 of hybrid device 28 are connected symmetrically to the antenna dipoles 26 and 27 via two separate semi-rigid RF feed cables 32 and 33, each having equal electrical length.

The RF feed cables 32 and 33 are specially formed to serve as both a high power RF feed line and as a sub-resonant choke balun, which is necessary for correct antenna operation. The balun consists of the semi-rigid RF feed cable wound in the form of a coil. The coils 34 and 35 which form the balun provide a high impedance inductive load as seen by the currents flowing on the outside surface of the RF cable 32 and the RF cable 33. The purpose of the balun is to suppress the unbalanced currents attempting to flow on the surface of the outer conductor of RF cables 32 and 33.

The components that comprise the PAB antenna assembly 20 described above are mounted onto the dielectric substrate 25. The basis of the PAB antenna assembly's strength and rigidity is attributed to the mechanical properties of the dielectric material used as the dielectric substrate 25. The dielectric material chosen for the dielectric substrate 25 has the characteristics of having a low relative permittivity constant, preferably in the range of 2 to 3, and possesses a low Loss Tangent property. The use of the dielectric substrate 25 is necessary for mechanical strength and rigidity to support the assemblage. The selected dielectric material should be as much electrically transparent as possible so as not to interfere with the operation of the antenna assembly.

Figure 2:
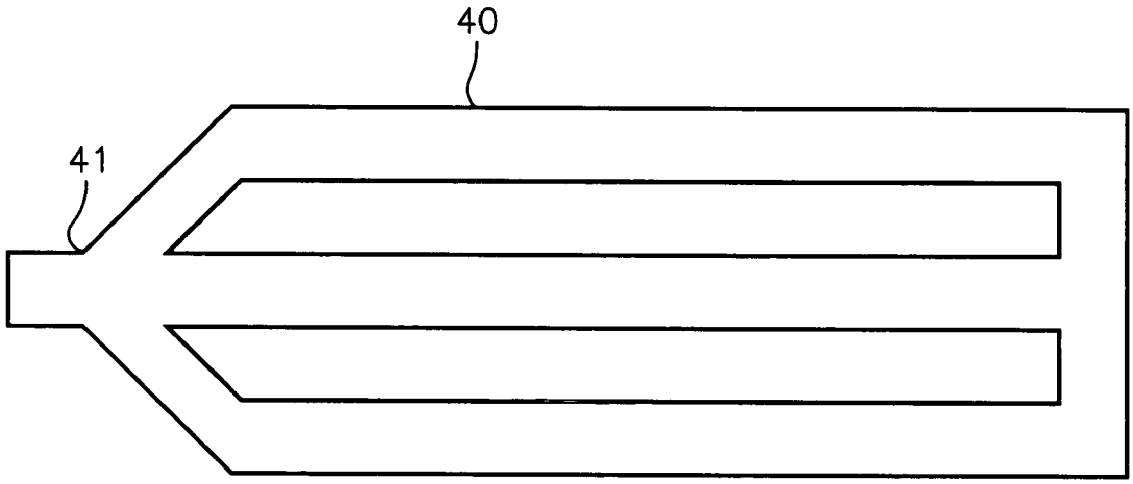
FIG. 2 is a view of the antenna blade construction for the Phased Array Blade (PAB) assembly of FIG. 1.

Referring to FIGS. 1 and 2, each antenna dipole element 26 and 27 consists of two symmetrical blades 36 and 40. Antenna blade 40 is shown in FIG. 2. The design of each blade 36 and 40 affords lightweight construction and also minimizes wind loading should the antenna be used in other than airborne applications. Antenna blade 40 has a fan out angle 41 of 45 degrees as shown in FIG. 2. Blade 36 of FIG. 1 also has a fan out angle of 45 degrees. The fan out angle 41 of 45 degrees contributes to the dipole element impedance reduction from 73 ohms down to 50 ohms to match the impedance of the semi-rigid RF feed cable 32 and 33 and thus obviates the need for an impedance matching network. The geometry of each blade 36 and 40 has an effect of extending the antenna frequency bandwidth to about 22%.

Figure 3:
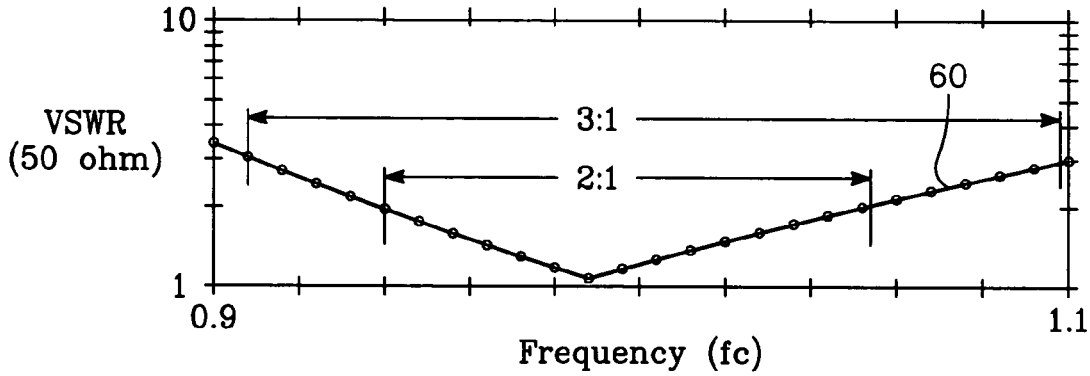
FIG. 3 is a plot of the PAB antenna VSWR for the Phased Array Blade (PAB) assembly of FIG. 7 produced by a CAD software derived from initial simulation results.
Figure 4:
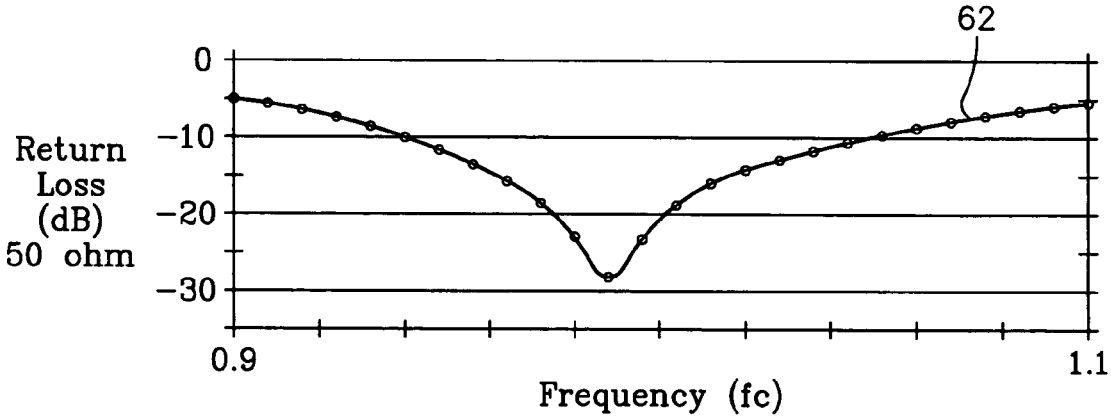
FIG. 4 is a plot of the PAB antenna Return Loss performance versus Frequency for the Phased Array Blade (PAB) assembly of FIG. 7 generated from a CAD software simulation.

Referring to FIGS. 3, 4, 5 and 6, the operating characteristics of the PAB antenna assembly 20 have been confirmed via limited software simulations depicted in plots 60 and 62 shown in FIGS. 3 and 4. Experimental test results show a multiplicity of several resonant impedance points plotted as a function of frequency and are included as FIGS. 5 and 6. The blade array antenna 2:1 VSWR bandwidth is shown as plot 64 in FIG. 5. This desirable broadband antenna impedance behavior and thus ultra low VSWR are all attributed to the peculiar three-prong antenna shape and the taper angle 41 of 45 degrees of each of the symmetrical blades 36 and 40.

Figure 5:
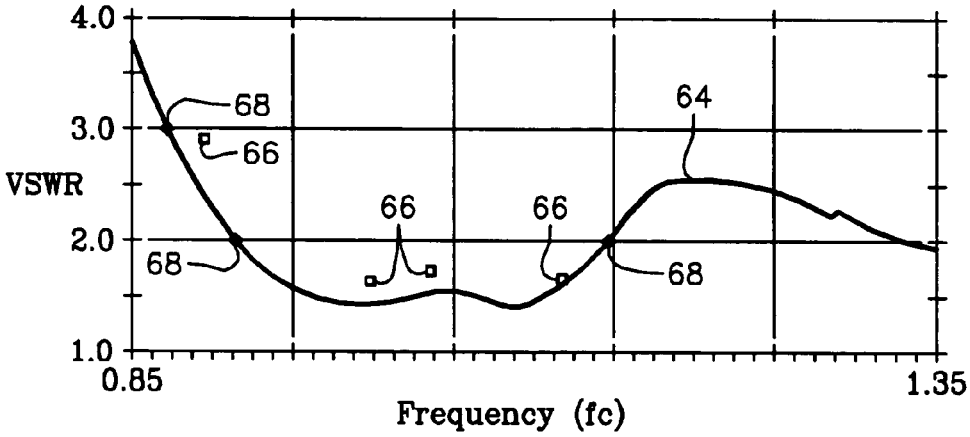
FIG. 5 is a plot of the measured VSWR Performance when the Phased Array Blade (PAB) assembly of FIG. 1 is installed on an aircraft.

The squares 66 of FIG. 5 are free space measurements performed in an anechoic chamber. A close correlation of the anechoic chamber measurements, the squares 66 and "on the airplane measurements", represented by the diamonds 68 in FIG. 5, indicate the antenna's reduced sensitivity to the aircraft ground plane effects due to EM field cancellation in proximity to the bottom section of the amplifier chassis.

Figure 6:
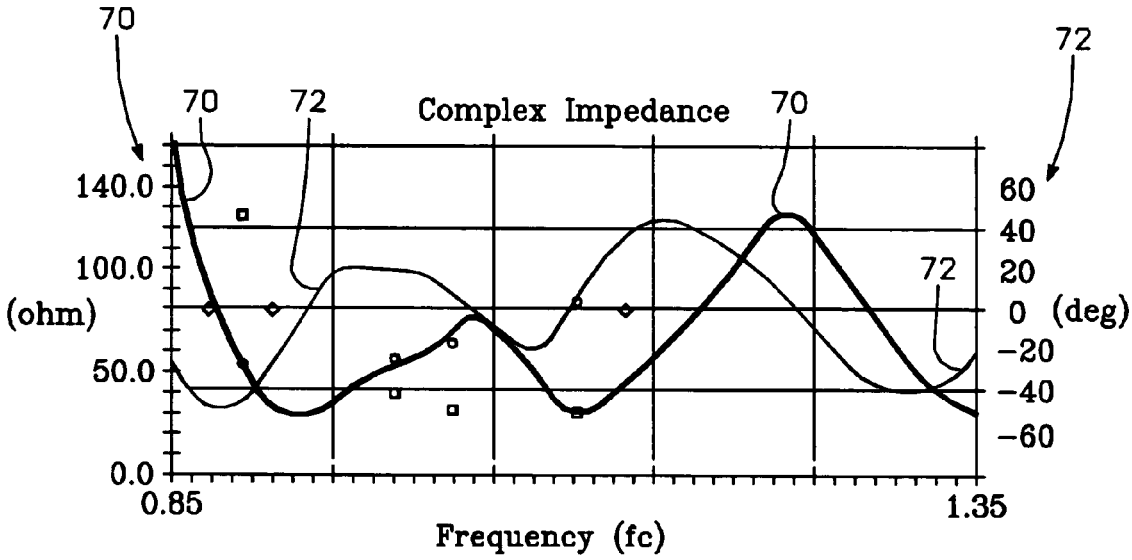
FIG. 6 is a plot of the measured RF Input Impedance when the Phased Array Blade (PAB) assembly of FIG. 1 is installed on an aircraft.

Antenna input impedance multiple zero phase crossings are indicated in the plots 70 and 72 of FIG. 6. The broadband antenna performance can be attributed to these non-monotonic reactive impedance characteristics.

Referring to FIG. 1, the RF feed line connection 84 to the antenna blade elements 26 and 36 can be accomplished in a number of ways depending upon whether it is desired to have the blades interchangeable or not. The simplest method would be to drill holes corresponding to the outer and inner diameter of the feed line 34 in the two antenna blades 26 and 36, respectively. Another method to achieve blade design commonality would be to have standard feed-thru adapter connectors installed in the threaded RF input orifices, one for the outer conductor and the other for the inner conductor, ensuring that precise electrical isolation exists between the two conductors. If the antenna blades 26 and 36 are constructed of a material that is dissimilar to that of the RF feed line's 34 metallic outer and inner conductor, a special design approach must be considered to prevent the dissimilar metal galvanic corrosion phenomenon. Towards that end, preventing moisture penetration is a critical strategy to inhibiting galvanic corrosion if direct contact between two dissimilar metals cannot be avoided.

Figure 7:
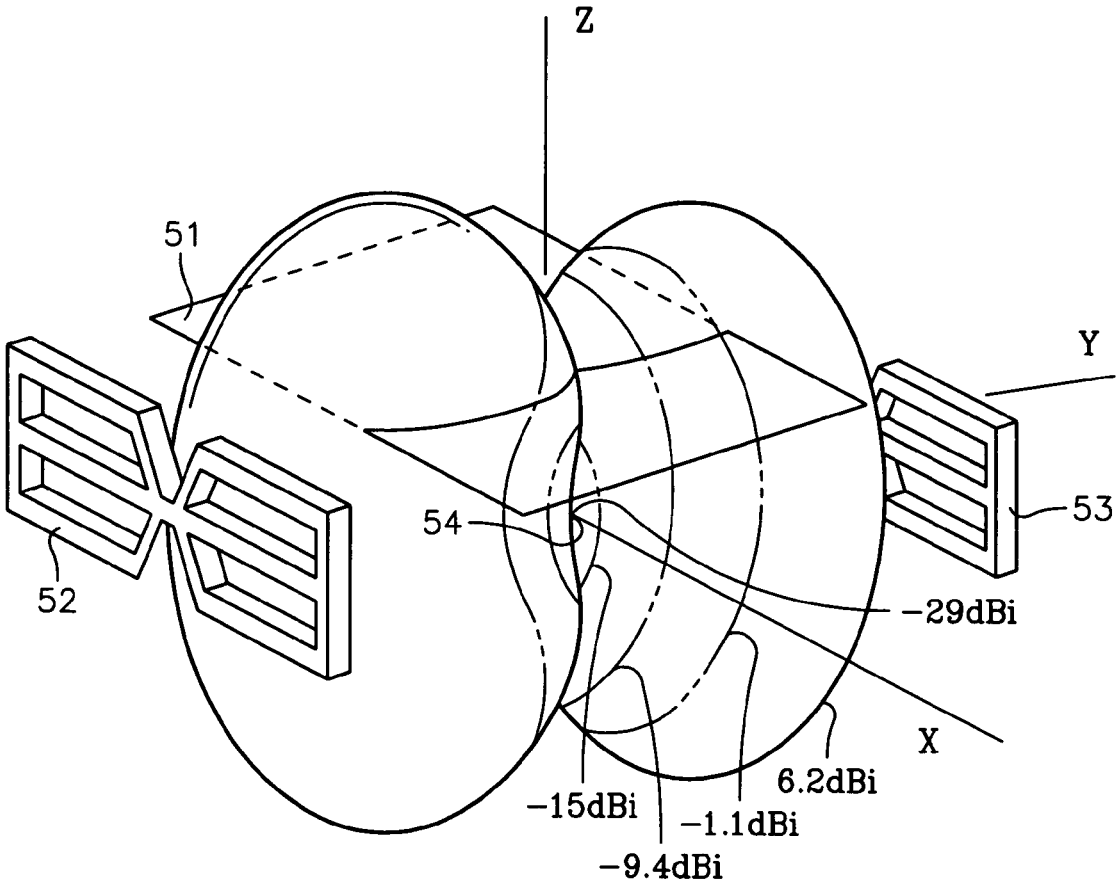
FIG. 7 is a simulated view of the three dimensional vertically aligned PAB antenna radiation pattern for the Phased Array Blade (PAB) assembly of FIG. 1.

Referring to FIGS. 1 and 7, the EM field cancellation feature is a characteristic that is inherent to the orientation and spatial arrangement of the transmitter and PAB antenna assembly and is illustrated in FIG. 7. The EM field which propagates between the two dipole antenna elements 26 and 27 is 180 degrees out of phase. This phase difference results in a cancellation of radiated waveforms in the center and in the forward and aft airplane directions (i.e. normal to the page). This orientation and spatial arrangement greatly reduces antenna interaction with an amplifier ground plane and other amplifiers that may be installed in the same pod. The reduced ground plane interaction has the effect of stabilizing the antenna input impedance and VSWR.

Referring to FIG. 7, FIG. 7 depicts the PAB antenna assembly's three dimensional radiation patterns 50 simulation results. The close proximity of the transmitter chassis ground plane effect, when installed on the aircraft, is simulated with a metal plate 51. The antenna blades 52 and 53 can be either aligned vertically or horizontally without too much difference in performance depending on the spatial constraints. In this case, vertical alignment was chosen to accommodate the maximum available width of the radome.

To illustrate the relative aircraft location reference in FIG. 7, the aircraft fuselage is aligned with the x-axis, the wings are aligned with the +/−y-axis and the +z-axis points in the upward direction. FIG. 7 also illustrates the field cancellation effect between the two dipole antenna blades 52 and 53. The field cancellation effect in this application is the key concept that allows the antenna to function so well in the airborne environment. The creation of a null point 54 at the intersection of the radiation patterns produced by each dipole antenna blade is illustrated in FIG. 7. Extremely close proximity of the antenna with relation to the transmitter's irregular surface ground plane has strong detrimental effects on other existing antenna systems in this frequency range. The new innovative PAB antenna assembly design avoids those problems by purposefully nearly eliminating the net EM fields in the most troublesome regions. It is due to these unique design features that the ability to maintain a stable and ultra low VSWR while at the same time providing good EM Interference suppression is achieved.

From the foregoing, it may readily be seen that the present invention comprises a new, unique and exceedingly useful and effective blade array antenna system which includes a pair of lightweight dipole blades designed to fit within a radome which constitutes a considerable improvement over the known prior art. Many modifications and variations of the present inventions are possible in light of the above teachings. It is therefore to be understood that within the scope of the claims the invention may be practiced otherwise than as specifically described.

What is claimed is:

1. A Phased Array Blade Antenna Assembly comprising:

a pair of dipole antenna elements spaced apart from one another by a preset distance, wherein the pair of dipole antenna elements includes two symmetrical antenna blades with each blade having a fan out angle of approximately 45 degrees;

a phase differential hybrid device for receiving an RF input signal and having multiple RF output ports, wherein the differential hybrid device includes a dummy load connected to one of said RF input ports;

a pair of coiled RF feed lines connecting the pair of dipole antenna elements to a pair of the RF output ports of said hybrid device, wherein each of the pair of coiled RF feed lines operates as a balun; and said dipole antenna elements, said hybrid device and said pair of coiled RF feed lines being rigidly mounted to a dielectric substrate, wherein a plurality of clamps are mounted on the dielectric substrate at selected points to achieve structural stability when said phased array blade antenna assembly is attached to and positioned within a radome.

2. The Phased Array Blade Antenna Assembly of claim 1, wherein each of the RF feed lines are coiled to create said balun which is a sub-resonant choke balun facilitating an impedance matching value of 50 ohms.

3. The Phased Array Blade Antenna Assembly of claim 1, wherein the dielectric substrate has a characteristic of a low relative permittivity constant, preferably in a range of 2 to 3 and a low Loss Tangent property.

4. The Phased Array Blade Antenna Assembly of claim 1, wherein separation of said pair of dipole antenna elements is set to radiate at the center frequency of interest.

5. The Phased Array Blade Antenna Assembly of claim 1, wherein the separation of said pair of dipole antenna elements is set to cancel a portion of an EM field, defined by a three dimensional radiation pattern and generated by each of said dipole antenna elements, that intersects.

6. A Phased Array Blade Antenna Assembly, comprising:

phase differential means for receiving an input RF signal, said phase differential means splitting the RF signal into two electrical RF signals that are out of phase and providing the two electrical RF signals to two separate output ports, said phase differential means including heat dissipating means for dissipating common mode currents as heat;

radiating means for transforming the two electrical RF signals into two intersecting three dimensional radiation patterns that have an EM field cancellation property at an intersection of said three dimensional radiation patterns extending overall operating frequency bandwidth to about 22%;

impedance matching means for coupling the output ports of the phase differential means to the radiating means; and structure means for rigidly mounting the phase differential means, the radiating means and the impedance matching means thereon, wherein the structure means accepts a plurality of clamps at selected points to achieve structural stability when said phased array blade antenna assembly is attached to and positioned within a radome.

7. The Phased Array Blade Antenna Assembly of claim 6, wherein the phase differential means is a broadband, high power, 180 degree phase differential hybrid device that receives the input RF signal and then splits the input RF signal into two electrical RF signals that are shifted 180 degrees out of phase, said phase differential means then outputting the two electrical RF signals to two separate output ports.

8. The Phased Array Blade Antenna Assembly of claim 6, wherein the radiating means is a pair of symmetrical antenna blades each having a radiation pattern, with each blade having a fan out angle of approximately 45 degrees and the pair of symmetrical antenna blades are positioned to aid the EM field cancellation property at the intersection of the three dimensional radiation patterns.

9. The Phased Array Blade Antenna Assembly of claim 6, wherein the impedance matching means is a pair of coiled RF feed lines acting as a balun which is used to obtain 50 ohms of impedance between said radiating means and said phase differential means.

10. The Phased Array Blade Antenna Assembly of claim 6, wherein the structure means is a dielectric substrate material having a characteristic of a low relative permittivity constant, preferably in a range of 2 to 3, for reducing the attenuation of said radiation patterns.

11. A Phased Array Blade Antenna Assembly comprising:

a pair of symmetrical dipole antenna elements positioned apart from one another by a selected distance, each dipole antenna element having a radiation pattern, wherein the pair of symmetrical dipole antenna elements are positioned to obtain EM field cancellation at an intersection of the radiation patterns resulting in a null that improves overall antenna assembly performance when installed in close proximity to other RF systems, wherein the pair of symmetrical dipole antenna element is made of a first blade electrically and mechanically coupled to a second blade with each of said blades having a fan out angle of 45 degrees providing an impedance of 50 ohms;

a phase differential hybrid device having an electrical RF input port and a set of electrical RF signal output ports, wherein said phase differential hybrid device is a broadband, high power, 180 degree phase differential hybrid device that receives an input electrical RF signal and then splits the input electrical RF signal into two electrical RF signals that are shifted 180 degrees out of phase, said differential hybrid device outputting the two electrical RF signals to two separate output ports, wherein the phase differential hybrid device includes a dummy load connected to an unused input port to dissipate common mode current as heat;

a pair of coiled RF feed lines connecting the pair of symmetrical dipole antenna elements to the electrical RF output ports of said phase differential hybrid device, wherein each of the coiled RF feed lines operates as a balun maintaining 50 ohms of impedance matching to minimize signal loss present during the coupling of said antenna elements to said hybrid device; and said pair of symmetrical dipole antenna elements, said phase differential hybrid device and said pair of coiled RF feed lines being rigidly mounted to a dielectric substrate by a plurality of clamps connected to the dielectric substrate at selected points to achieve structural stability when the phased array blade assembly is attached to and positioned within a radome and providing the RF transparency necessary to minimize attenuation of said radiation patterns.

* * * * *